US009969188B2

(12) United States Patent
Mashima

(10) Patent No.: US 9,969,188 B2
(45) Date of Patent: May 15, 2018

(54) RECORDING APPARATUS AND MOVING METHOD

(71) Applicant: SEIKO EPSON CORPORATION, Tokyo (JP)

(72) Inventor: Akira Mashima, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 221 days.

(21) Appl. No.: 15/000,294

(22) Filed: Jan. 19, 2016

(65) Prior Publication Data

US 2016/0221365 A1 Aug. 4, 2016

(30) Foreign Application Priority Data

Jan. 27, 2015 (JP) ..... 2015-013030

(51) Int. Cl.

| | |
|---|---|
| ***B41J 13/00*** | (2006.01) |
| ***B41J 11/06*** | (2006.01) |
| ***B41J 3/28*** | (2006.01) |
| ***B41J 3/407*** | (2006.01) |
| ***B41J 11/20*** | (2006.01) |
| ***B41J 11/00*** | (2006.01) |

(52) U.S. Cl.

CPC ..... *B41J 11/06* (2013.01); *B41J 3/28* (2013.01); *B41J 3/4078* (2013.01); *B41J 11/007* (2013.01); *B41J 11/20* (2013.01); *B41J 13/0009* (2013.01)

(58) Field of Classification Search

CPC ..... B41J 2/01; B41J 3/28; B41J 3/4078; B41J 11/007; B41J 11/20; B41J 13/009

See application file for complete search history.

(56) References Cited

U.S. PATENT DOCUMENTS

| | | | | |
|---|---|---|---|---|
| 6,883,911 | B2 * | 4/2005 | Niimi | B41J 11/06 101/126 |
| 7,513,583 | B2 * | 4/2009 | Niimi | B41J 3/28 347/16 |
| 8,820,874 | B2 * | 9/2014 | Yanagishita | B41J 3/4078 347/104 |
| 2005/0068400 | A1 | 3/2005 | Niimi et al. | |
| 2007/0195119 | A1 | 8/2007 | Niimi | |

FOREIGN PATENT DOCUMENTS

| | | | |
|---|---|---|---|
| JP | 2005-096379 | A | 4/2005 |
| JP | 2007-223074 | A | 9/2007 |

* cited by examiner

*Primary Examiner* — Anh T. N. Vo
(74) *Attorney, Agent, or Firm* — Workman Nydegger

(57) ABSTRACT

A recording apparatus includes a recording portion capable of executing recording on a medium, a support portion that supports the medium and that is movable in a movement direction, and a movement operation portion that accepts a movement operation for moving the support portion to a desired position in the movement direction. Due to this construction, the support portion movable in the movement direction can be easily moved to any desired position in the movement direction.

9 Claims, 8 Drawing Sheets

RECORDING APPARATUS AND MOVING METHOD

BACKGROUND

1. Technical Field

The present invention relates to a recording apparatus and a moving method.

2. Related Art

Recording apparatuses that have a recording medium supported by a support portion movable in movement directions and that perform recording on the medium supported by the support portion have been in use.

For example, JP-A-2007-223074 discloses a cloth printing apparatus (recording apparatus) that includes a platen feed button able to accept an operation for moving the platen as a support portion and that is capable of moving a cloth of a T-shirt or the like as a medium to a setting position when the platen feed button is depressed.

In a recording apparatus that includes a support portion that is movable in the movement directions, being capable of moving the support portion to any desired position will improve the convenience in use. Being able to move the support portion to any desired position is convenient, for example, when a user desires to move the support portion to a desired position in order to check a positional relation (an interval or the like) between a medium and the recording portion prior to execution of the recording, when, in order to check the state of recording by the recording portion, a test pattern is recorded while the recording position is arbitrarily changed, or the like.

However, the related-art recording apparatuses equipped with a support portion movable in the movement directions are not constructed so that the support portion can be easily moved to any desired position. Therefore, in order to move the support portion to a desired position, a user needs to manually change the position of the support portion when the electric power supply is off, which imposes a burden of operation on the user or sometimes gives a load to the apparatus by, for example, generating a counter electromotive force on a moving mechanism of the support portion.

SUMMARY

An advantage of some aspects of the invention is that a support portion movable in a movement direction is easily moved to a desired position.

A recording apparatus according to a first aspect of the invention includes a recording portion capable of executing recording on a medium, a support portion that supports the medium and that is movable in a movement direction, and a movement operation portion that accepts a movement operation for moving the support portion to a desired position in the movement direction.

In the recording apparatus according to the first aspect of the invention, the movement operation portion may accept the movement operation when the recording portion is not executing the recording.

Furthermore, the movement operation portion may avoid accepting the movement operation when the recording portion is executing the recording.

The above-described recording apparatus may be capable of changing moving speed of the support portion according to duration of the movement operation accepted by the movement operation portion.

Furthermore, the movement operation portion may be formed in such a surface as to be visible in a plan view of the recording apparatus.

The above-described recording apparatus may further include an operation panel that accepts various operations regarding the recording, and the movement operation portion may be disposed in a vicinity of the operation panel.

Furthermore, the movement operation portion may be disposed in a vicinity of a setting position at which the medium is set onto the support portion.

Still further, the movement operation portion may be capable of accepting the movement operation in a state in which the movement operation portion is remote from the recording apparatus.

A moving method according to a second aspect of the invention is a support portion moving method for a recording apparatus that includes a recording portion capable of executing recording on a medium and a support portion that supports the medium and that is movable in a movement direction. The support portion moving method includes moving the support portion to a desired position in the movement direction by using a movement operation portion.

According to the invention, the support portion movable in the movement direction can be easily moved to any desired position in the movement direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Recording apparatuses according to exemplary embodiments of the invention will be described in detail hereinafter with reference to the drawings.

Exemplary Embodiment 1 (FIG. 1 to FIG. 6)

First, a recording apparatus according to Exemplary Embodiment 1 of the invention will be described.

Figure 1:
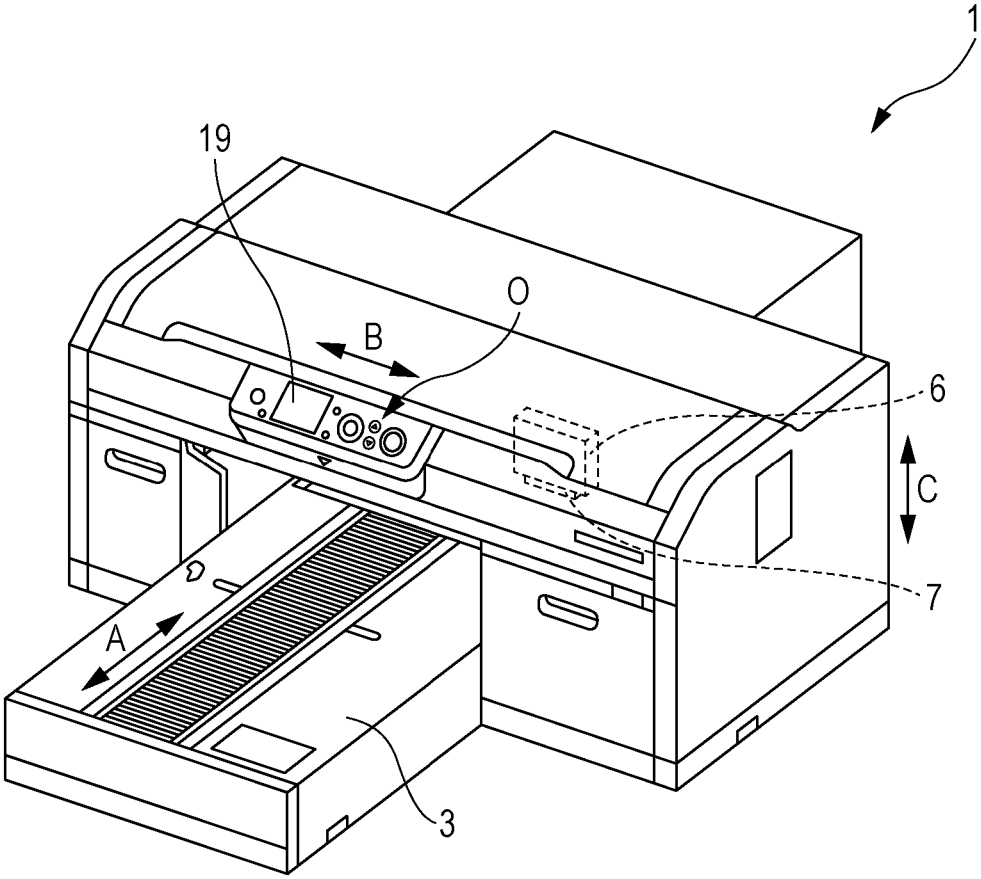
FIG. 1 is a schematic perspective view of a recording apparatus according to Exemplary Embodiment 1 of the invention.
Figure 2:
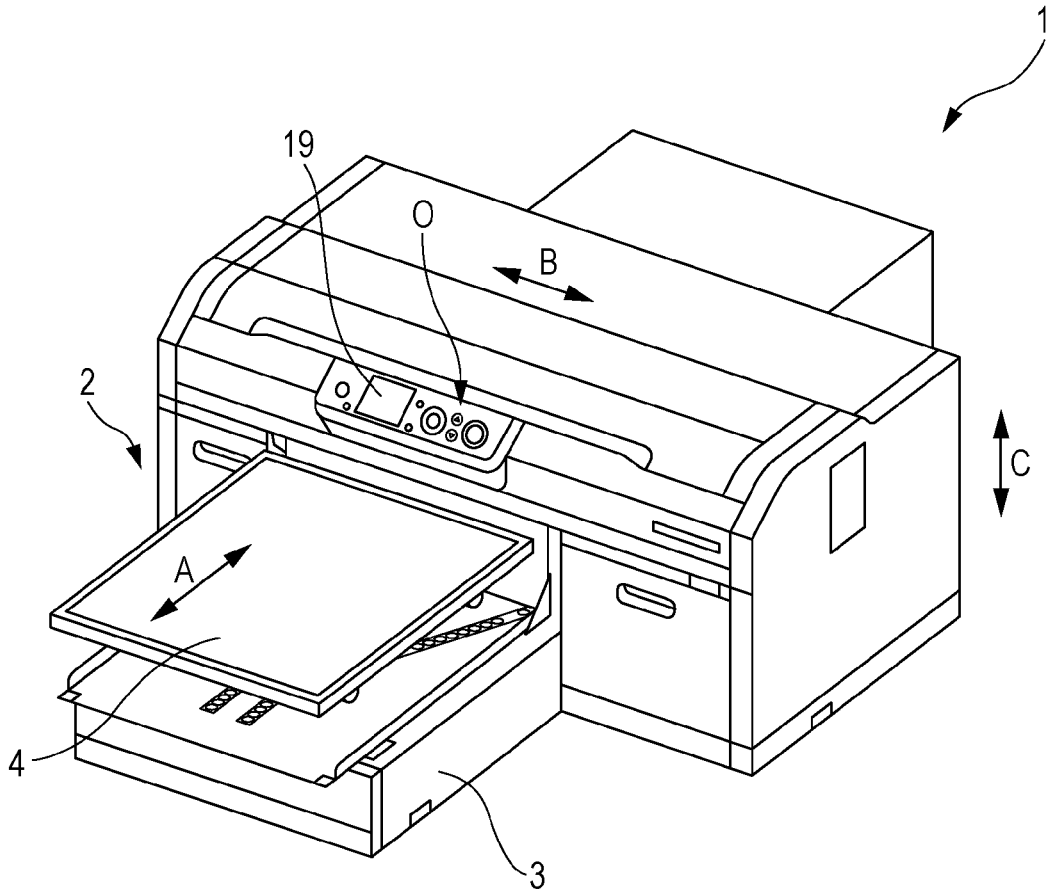
FIG. 2 is a schematic perspective view of the recording apparatus according to Exemplary Embodiment 1 of the invention.

FIG. 1 and FIG. 2 are schematic perspective views of a recording apparatus 1 according to Exemplary Embodiment 1 of the invention. Of these, FIG. 1 presents a state in which a tray 4 as a support portion of the recording apparatus 1 of this exemplary embodiment is at a recording start position, and FIG. 2 presents a state in which the tray 4 is at a setting position at which to set a medium.

Figure 3:
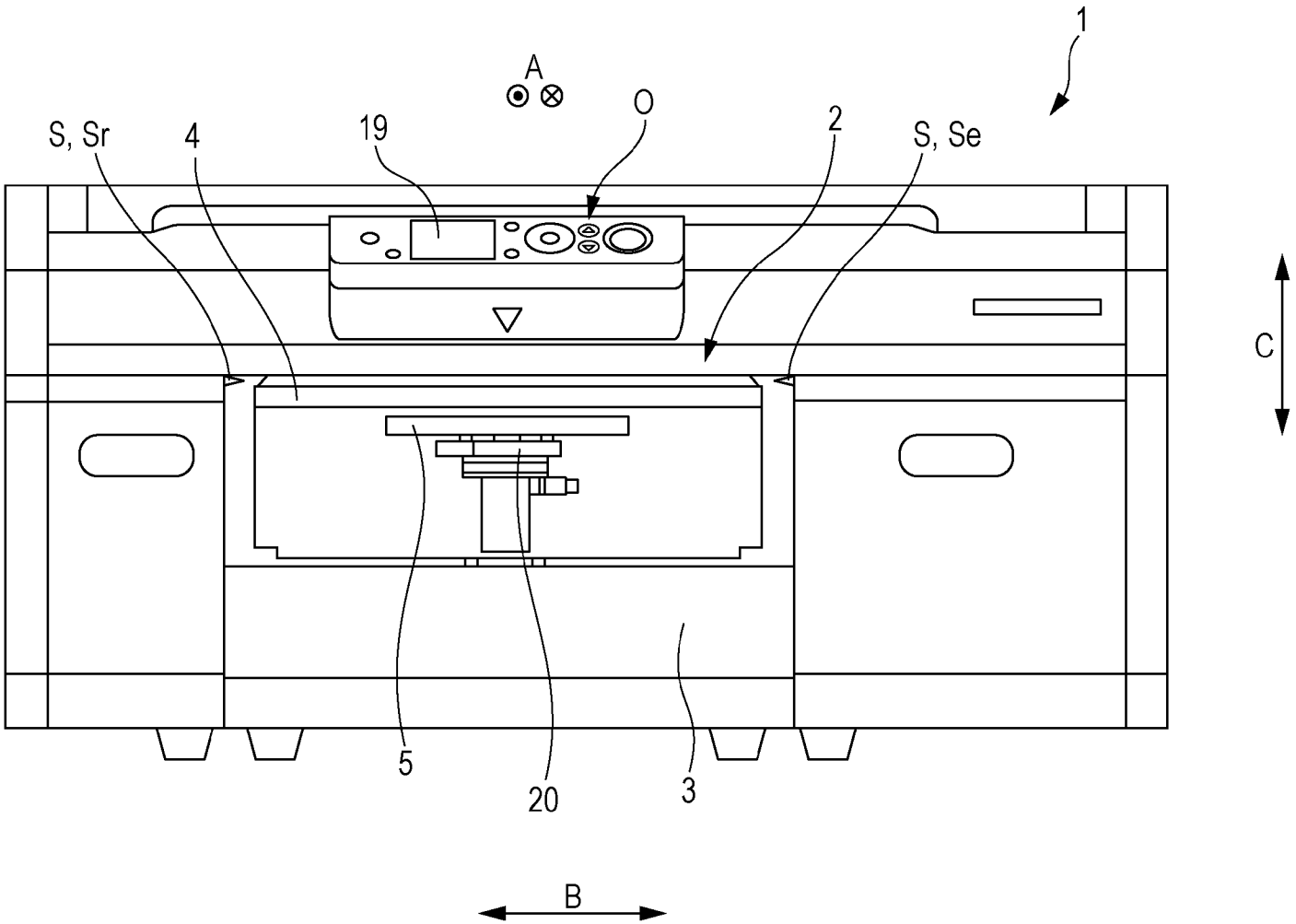
FIG. 3 is a schematic front view of the recording apparatus according to Exemplary Embodiment 1 of the invention.

FIG. 3 is a schematic front view of the recording apparatus 1 of this exemplary embodiment.

Figure 4:
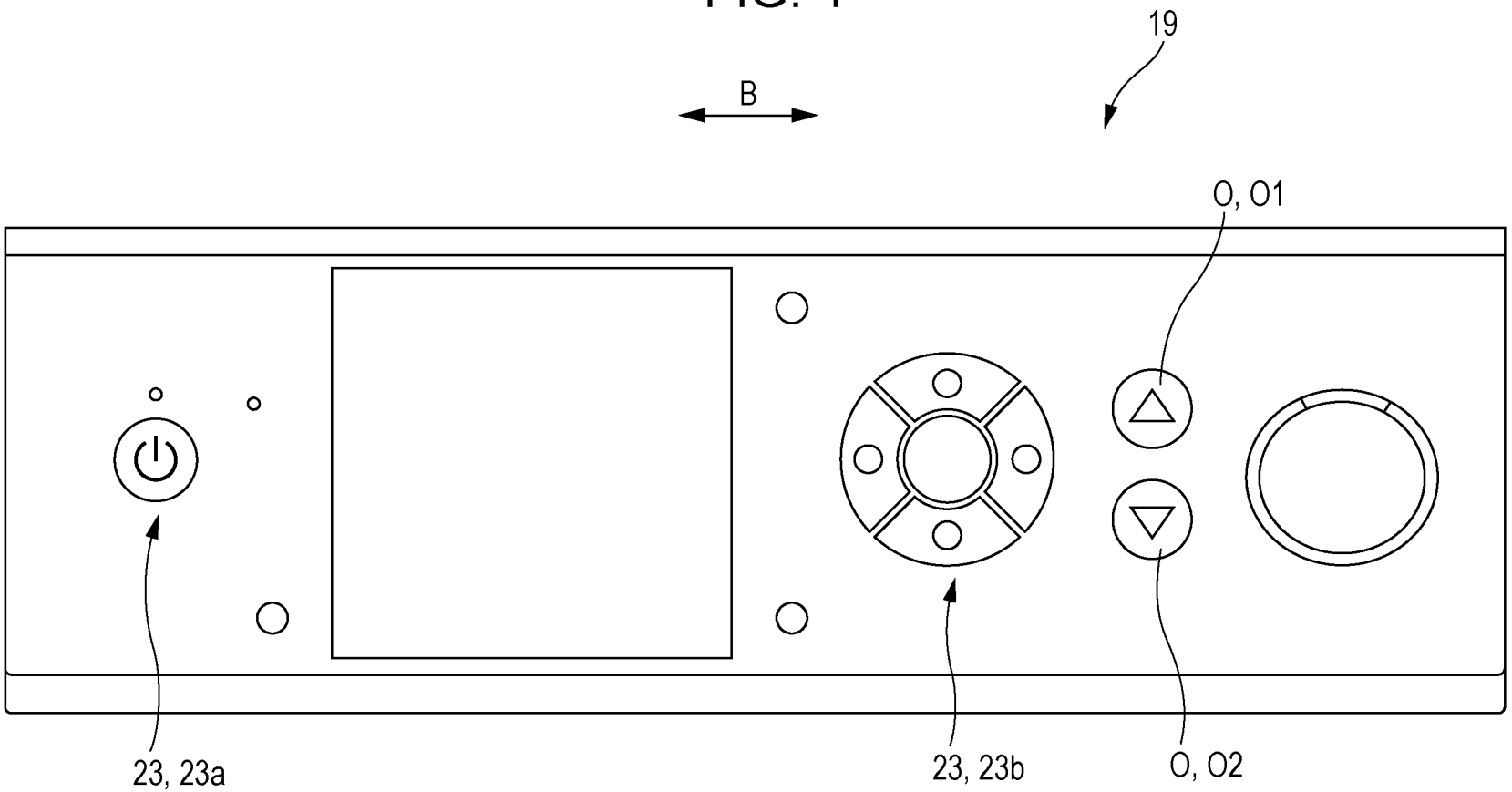
FIG. 4 is a schematic perspective view presenting portions of the recording apparatus according to Exemplary Embodiment 1 of the invention.

FIG. 4 is a schematic perspective view of an operation panel 19 that is a portion of the recording apparatus 1 of this exemplary embodiment, viewed from above a front side of the recording apparatus 1.

The recording apparatus 1 of this exemplary embodiment includes a medium support unit 2 that moves in movement directions A while supporting a medium. The medium support unit 2 has a tray 4 that is a support portion for the medium.

The recording apparatus 1 includes a medium transport portion 3 that transports the medium supported on the tray 4 to the movement directions A. Furthermore, the tray 4 is mounted on a stage 5. The tray 4, together with the stage 5, is moved in a height direction C by rotating a rotation lever 20.

Furthermore, inside a main body of the recording apparatus 1 there is provided a recording head 7 capable of performing recording on a medium by ejecting ink onto the medium. In this exemplary embodiment, the recording head 7 corresponds to a recording portion that is capable of executing recording on a medium. The recording apparatus 1 of this exemplary embodiment forms a desired image by ejecting ink from the recording head 7 onto the medium supported by the tray 4 while moving the recording head 7 back and forth in intersecting directions B that intersect the movement directions A by moving a carriage 6 on which the recording head 7 is provided back and forth in the intersecting directions B. As for the recording apparatus 1 of this exemplary embodiment, the setting position (corresponding to the state shown in FIG. 2) at which a medium is set on the tray 4 is at a front or near side in FIGS. 1 and 2 (a bottom left side in these drawings). The recording apparatus 1 moves the tray 4 with the medium set thereon from the setting position to the recording start position (corresponding to the state shown in FIG. 1) that is at a back or far side in FIGS. 1 and 2 (a top right side in these drawings). After that, the recording apparatus 1 performs recording while moving the tray 4 to the front side.

Note that although the recording apparatus 1 of this exemplary embodiment includes the recording head 7 that performs recording while moving back and forth in the intersecting directions B, the invention is also applicable to a recording apparatus that includes a so-called line head in which a plurality of nozzles that eject ink are arranged in the intersecting directions B that intersect the movement directions A.

Note that the "line head" is a recording head in which a region where nozzles are formed in the intersecting directions B that intersect the movement directions A of the medium is provided so as to cover the entire width of the medium in the intersecting directions B and which is for use in a recording apparatus that forms images by moving a recording head and a recording medium relative to each other. Incidentally, the region of the line head's nozzles extending in the intersecting directions B does not necessarily need to be capable of covering the entire widths of all types of media that can be handled by the recording apparatus in the intersecting directions B.

Furthermore, although the recording head 7 of this exemplary embodiment is a recording portion capable of recording by ejecting ink in the form of liquid onto the medium, the recording head in the invention is not limited to such a recording portion; for example, a transfer type recording portion that performs recording by transferring color materials to a recording medium may also be used.

Furthermore, the recording apparatus 1 of this exemplary embodiment includes a sensor S as presented in FIG. 3 and is configured to be capable of detecting the presence or absence of abnormality regarding the gap between the recording head 7 and the medium supported by the tray 4 (abnormality in which the gap between the medium and the recording head 7 is excessively small).

The sensor S includes a light emitting portion Se and a light receiving portion Sr. The sensor S emits light from the light emitting portion Se toward the light receiving portion Sr, and detects the presence or absence of abnormality regarding the gap on the basis of whether the light receiving portion Sr has received light. However, this construction is not restrictive.

Furthermore, the recording apparatus 1 of this exemplary embodiment includes an operation panel 19 that accepts various operations regarding recording.

The operation panel 19 includes, as presented in FIG. 4, operation buttons 23 whereby various operations regarding recording can be input (an on/off button 23*a* for electric power supply and various instruction input buttons 23*b*) and a move button O1 and a move button O2 provided as a movement operation portion O for accepting movement operations for moving the tray 4. The movements of the tray 4 based on the move buttons O1 and O2 will be described later.

Thus, the recording apparatus 1 of this exemplary embodiment includes the recording head 7 as a recording portion capable of performing recording on the medium and the tray 4 as a support portion capable of supporting the medium and moving in the movement directions A.

The recording apparatus 1 also includes a movement operation portion O that accepts a movement operation for moving the tray 4 to a desired position in the movement directions A. In other words, the tray 4 is moved to a desired position in the movement directions A by using the movement operation portion O.

Therefore, the tray 4 can be easily moved to any desired position by operating the movement operation portion O.

As presented in FIGS. 1 to 4, the movement operation portion O in this exemplary embodiment is provided in such a surface in the operation panel 19 that the movement operation portion O is visible in a plan view of the recording apparatus 1. It can also be said that the movement operation portion O is provided in such a surface as to be visible in a plan view of a movement path of the tray 4 in the movement directions A.

Therefore, the movement operation of moving the tray 4 to a desired position in the movement directions A can be easily executed. If, as in this exemplary embodiment, the movement operation portion O for the tray 4 is constructed of buttons (the move buttons O1 and O2) arranged along the movement directions A of the tray 4, a lever operable (movable) along the movement directions A of the tray 4, etc., in a surface that is visible in a plan view of the recording apparatus 1, a user can intuitively grasp the operations of the movement operation portion O. This is because a user can look down at the movement operation portion O from above so that the correspondence relation between the operations of the movement operation portion O and the movements of the tray 4 can be more easily grasped.

Note that even if there is a deviation from a direction along the movement directions of the tray 4, a construction in which the directions of arrangement and operation of the movement operation portion O for the tray 4 have vector components along the movement directions A of the tray 4 allows users to intuitively grasp the operations of the movement operation portion O.

The movement operation portion O of this exemplary embodiment is configured so that when the move button O1 is depressed, the tray 4 is moved in one of the movement directions A that is a direction from a medium setting position side to a recording start position side and so that when the move button O2 is depressed, the tray 4 is moved in the other one of the movement directions A, that is, a direction from the recording start position side to the medium setting position side.

Note that although the movement operation portion O in this exemplary embodiment is disposed in the operation panel 19 that accepts various operations regarding recording, the invention is not limited by this disposal. However, it is preferable that the movement operation portion O be disposed in the vicinity of the operation panel 19.

Note that the "vicinity of the operation panel 19" means a range within the reach of a user who is at a position where the user can operate the operation panel 19 and this expression is used in this specification to cover a construction in which the movement operation portion O is disposed in the operation panel 19 as in this exemplary embodiment.

The foregoing disposal allows the movement operation portion O to be easily operated by a user at a position where the user can operate the operation panel 19.

Next, an electrical construction of the recording apparatus 1 of this exemplary embodiment will be described.

Figure 5:
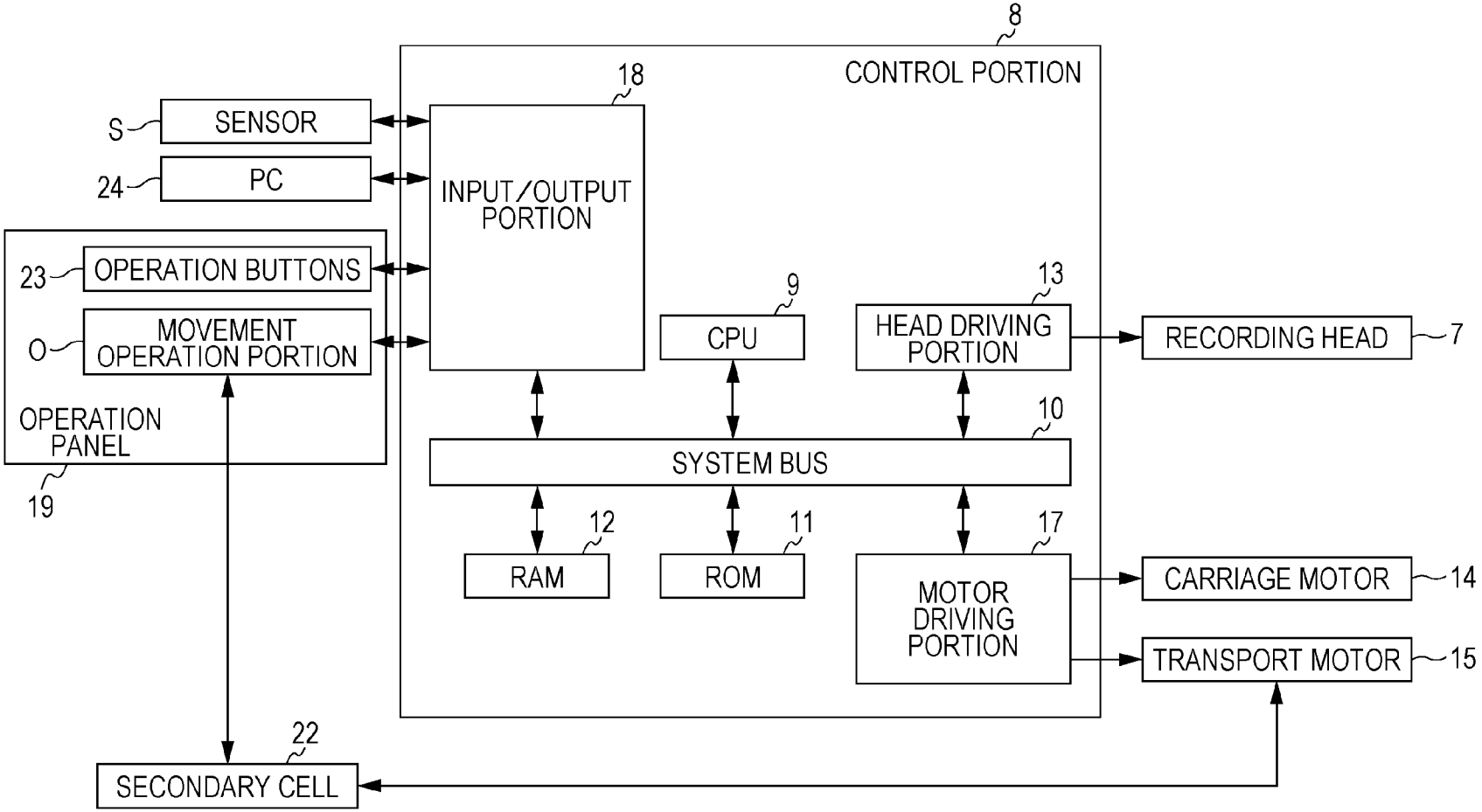
FIG. 5 is a block diagram of the recording apparatus according to Exemplary Embodiment 1 of the invention.

FIG. 5 is a block diagram of the recording apparatus 1 of this exemplary embodiment.

A control portion 8 is provided with a CPU 9 that performs overall control of the recording apparatus 1. The CPU 9 is connected via a system bus 10 to a ROM 11 that stores various control programs and maintenance sequences that the CPU 9 executes, etc., and a RAM 12 capable of temporarily storing data.

The CPU 9 is also connected via the system bus 10 to a head driving portion 13 for driving the recording head 7.

Furthermore, the CPU 9 is connected via the system bus 10 to a motor driving portion 17. The motor driving portion 17 is connected to a carriage motor 14 for moving the carriage 6 provided with the recording head 7 and a transport motor 15 that is provided in the medium transport portion 3 so as to transport the medium.

The CPU 9 is further connected via the system bus 10 to an input/output portion 18. The input/output portion 18 is connected to the sensor S, the operation buttons 23 and the movement operation portion O (the move buttons O1 and O2) that are provided in the operation panel 19, and a personal computer (PC) 24 for receiving and sending signals, data such as recording data, etc.

The movement operation portion O and the transport motor 15 are connected to a secondary cell 22 that is connected to a main electric power supply (not shown in the drawings) of the recording apparatus 1. Therefore, even when the main electric power supply of the recording apparatus 1 is off, a user can operate the movement operation portion O to move the medium support unit 2 (the tray 4) to any desired position in the movement directions A.

Furthermore, the movement operation portion O is configured to be able to accept a movement operation for moving the tray 4 to a desired position in the movement directions A when the control portion 8 is not performing a control that causes the recording head 7 to execute recording. Therefore, the recording apparatus 1 of this exemplary embodiment is capable of moving the tray 4 to any desired position without impeding the recording operation.

The movement operation portion O is also configured to avoid accepting the movement operation when the recording head 7 is executing recording. Therefore, the recording apparatus 1 of this exemplary embodiment is capable of restraining the interference with the recording operation from being caused by acceptance of the movement operation during recording.

Due to this configuration, the recording apparatus 1 of this exemplary embodiment is capable of moving the tray 4 to any desired position in the movement directions A even when the main electric power supply of the recording apparatus 1 is off provided that the secondary cell 22 stores a predetermined amount of charge. However, this configuration is not restrictive.

For example, it is permissible to adopt a construction in which a timer is provided and in which the tray 4 can be moved to any desired position in the movement directions A for a predetermined amount of time after the main electric power supply of the recording apparatus 1 is turned off.

Furthermore, for example, a construction in which the movement operation portion O and the transport motor 15 are provided with an electric power supply separate from and independent of the main electric power supply may also be adopted.

Figure 6:
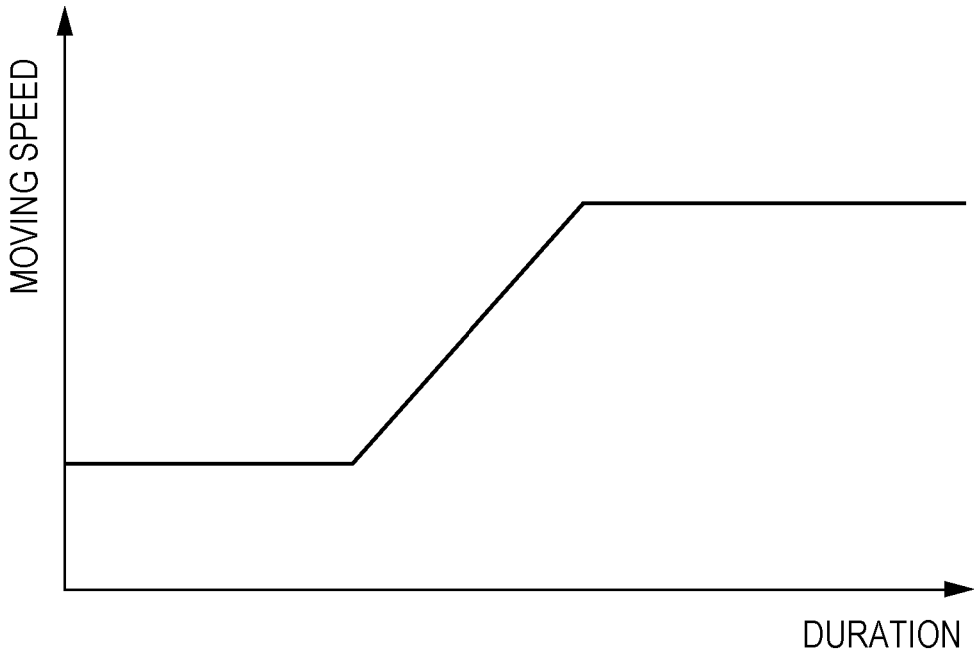
FIG. 6 is a graph presenting the moving speed of a support portion of the recording apparatus according to Exemplary Embodiment 1 of the invention.

Next, the movement of the tray 4 based on the move buttons O1 and O2 will be described. FIG. 6 is a graph presenting the moving speed of the tray 4 in relation to the depression time of the move buttons O1 and O2. In the graph, the vertical axis represents the moving speed of the tray 4. The horizontal axis represents the duration of the movement operation (the continued depression time of the move buttons O1 and O2).

As presented in FIG. 6, in the recording apparatus 1 of this exemplary embodiment, the moving speed of the tray 4 becomes faster when the continued depression time of the move button O1 or O2 exceeds a predetermined amount of time. In other words, the recording apparatus 1 of this exemplary embodiment is configured so as to be capable of changing the moving speed of the tray 4 according to the duration of the movement operation that is accepted by the movement operation portion O.

Note that the "duration of the movement operation" means the time during which an operation of moving the tray (a move instruction) continues being carried out due to the movement operation portion O (the continued depression time of the move button O1 or O2).

Thus, when a user presses and holds the move button O1 or O2 of the movement operation portion O to continue inputting a move instruction regarding the movement operation, the recording apparatus 1 increases the moving speed of the tray 4 to efficiently move the tray 4.

Although the recording apparatus 1 of this exemplary embodiment is configured to be capable of changing the moving speed of the tray 4 between the two levels in relation to the depression time of the move button O1 or O2, this configuration is not restrictive. For example, the moving speed of the tray 4 may be capable of being changed between three or more levels or steps. Furthermore, instead of the configuration in which the moving speed is changed in a stepped manner, a configuration in which the moving speed of the tray 4 is gradually increased with increases in the duration of the depressed state of the move button O1 or O2 may also be adopted.

Figure 7:
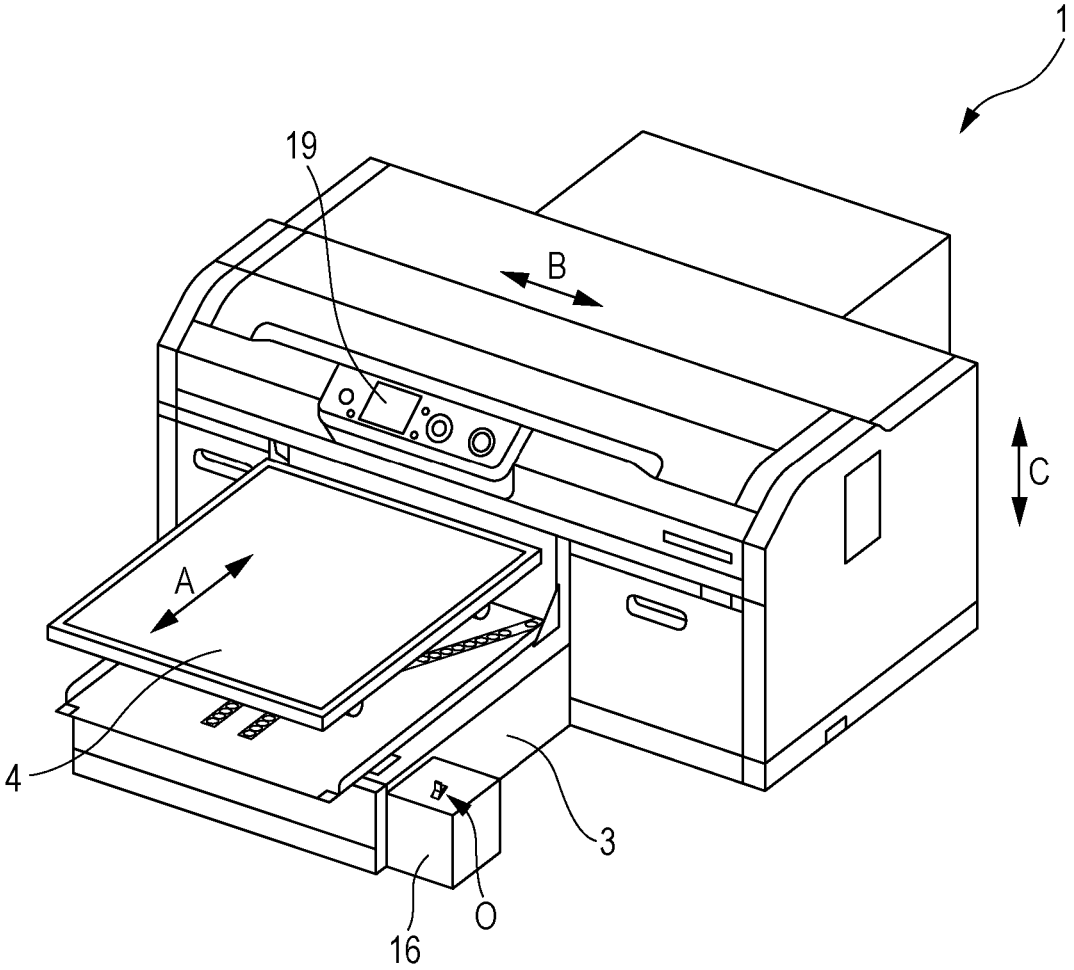
FIG. 7 is a schematic perspective view of a recording apparatus according to Exemplary Embodiment 2 of the invention.
Figure 8:
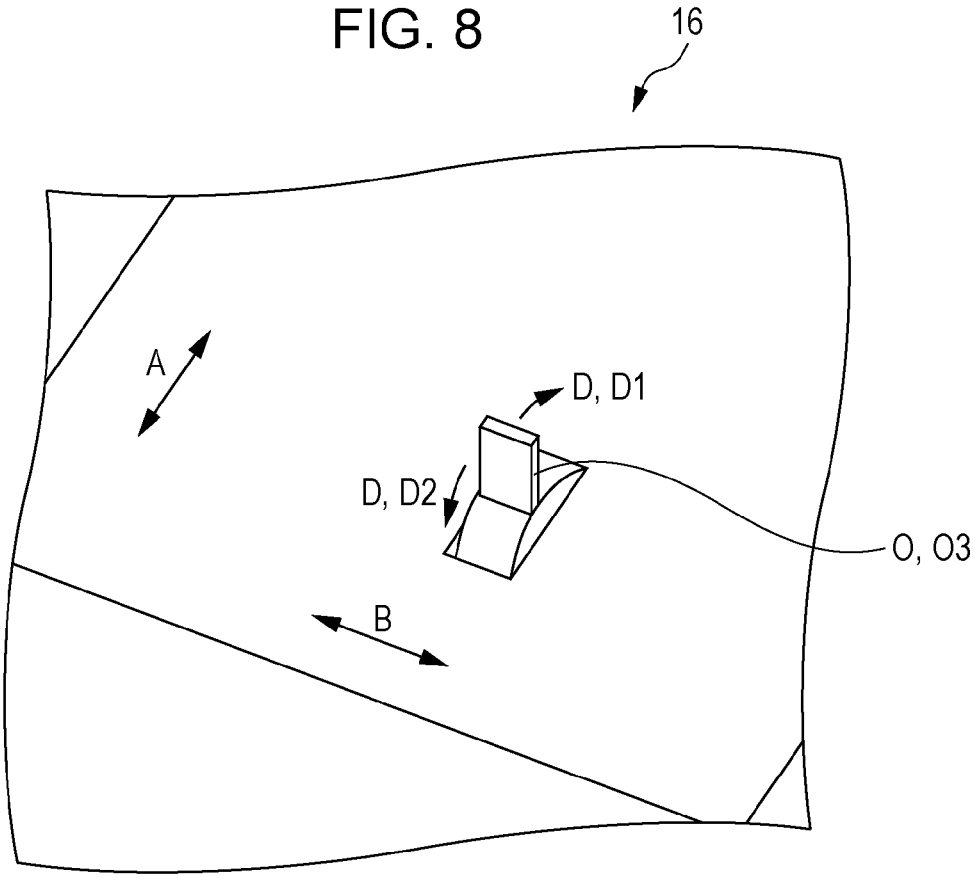
FIG. 8 is a schematic perspective view presenting portions of the recording apparatus according to Exemplary Embodiment 2 of the invention.

Exemplary Embodiment 2 (FIG. 7 and FIG. 8)

Next, a recording apparatus according to Exemplary Embodiment 2 of the invention will be described. FIG. 7 is a schematic perspective view of a recording apparatus 1 according to Exemplary Embodiment 2 of the invention, corresponding to FIG. 2, which presents the recording apparatus 1 of Exemplary Embodiment 1. FIG. 8 is a schematic perspective view of a movement operation portion-formed portion 16 that is a portion of the recording apparatus 1 according to Exemplary Embodiment 2 of the invention. Incidentally, the component members comparable to those of the Exemplary Embodiment 1 described above are denoted by the same reference characters and detailed descriptions thereof are omitted below.

The recording apparatus 1 of this exemplary embodiment is different from the recording apparatus 1 of Exemplary Embodiment 1 only in a construction in which the movement operation portion O is not formed in the operation panel 19 but instead a movement operation portion-formed portion 16 is provided.

As presented in FIG. 7, the movement operation portion-formed portion 16 in this exemplary embodiment is provided in a side surface portion of a medium transport portion 3, that is, a front side (a near side in FIG. 7) of the recording apparatus 1. In other words, the movement operation portion-formed portion 16 in this exemplary embodiment is disposed in the vicinity of a setting position at which a medium is set onto the tray 4.

Note that the "vicinity of the setting position" means a range within the reach of a user at a position where the user can set a medium onto the tray 4.

Due to this configuration, the recording apparatus 1 of this exemplary embodiment allows the user to easily operate the movement operation portion O while being at a position where the user can set a medium onto the tray 4.

As presented in FIG. 8, the movement operation portion O in this exemplary embodiment is disposed in such a surface as to be visible in a plan view of the recording apparatus 1 and includes a lever O3 that is operated (moved) in operation directions D along the movement directions A of the tray 4. When the lever O3 is moved in a direction D1 that is one of the operation directions D, the tray 4 is moved in a direction from a medium setting position side to a recording start position side that is one of the movement directions A. When the lever O3 is moved in a direction D2 that is the other one of the operation directions D, the tray 4 is moved in a direction from the recording start position side to the medium setting position side that is the other one of the movement directions A. That is, the direction in which the lever O3 is inclined and the direction in which the tray 4 moves coincide in a plan view. Due to this construction, users can intuitively grasp the operations of the movement operation portion O.

Figure 9:
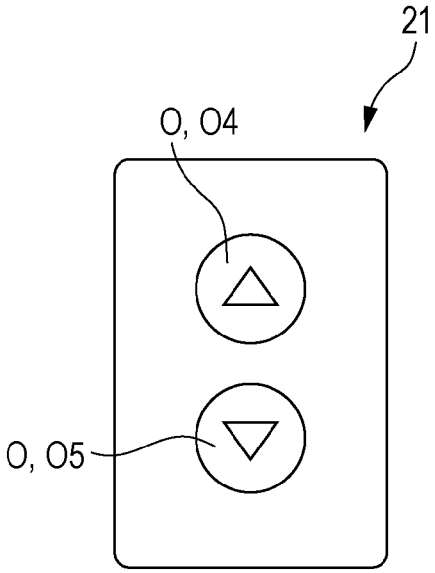
FIG. 9 is a schematic diagram presenting portions of a recording apparatus according to Exemplary Embodiment 3 of the invention.

Exemplary Embodiment 3 (FIG. 9)

Next, a recording apparatus according to Exemplary Embodiment 3 of the invention will be described.

FIG. 9 is a schematic diagram of a remote controller 21 that has a movement operation portion O that is a portion of a recording apparatus 1 according to Exemplary Embodiment 3 of the invention. Incidentally, component members comparable to those of Exemplary Embodiment 1 described above are denoted by the same reference characters and detailed descriptions thereof are omitted below.

The recording apparatus 1 of this exemplary embodiment is different from the recording apparatus 1 of Exemplary Embodiment 1 only in a construction in which a movement operation portion O is not formed in an operation panel 19 but instead a movement operation portion O is provided in the remote controller 21.

The recording apparatus 1 of this exemplary embodiment includes the remote controller 21 that has the movement operation portion O. Therefore, using the remote controller 21, a user of the recording apparatus 1, even when remote from the recording apparatus 1, can execute a movement operation of moving the tray 4 to a desired position in the movement directions A. In other words, the movement operation portion O is capable of accepting the movement operation even when remote from the recording apparatus 1.

Therefore, the user can easily operate the movement operation portion O even when at a position remote from the recording apparatus 1.

Although the remote controller 21 in this exemplary embodiment is configured to be capable of accepting the movement operation wirelessly, the remote controller 21 may also be configured to be capable of accepting the movement operation via a cable.

The movement operation portion O in this exemplary embodiment includes move buttons O4 and O5. When the move button O4 is pressed, the tray 4 is moved in a direction from a medium setting position side to a recording start position side that is one of the movement directions A. When the move button O5 is pressed, the tray 4 is moved in a direction from the recording start position side to the medium setting position side that is the other one of the movement directions A.

Incidentally, it should be apparent that the invention is not limited by the foregoing exemplary embodiments but can be modified and changed in various manners within the scope of the invention described in the appended claims and that such changes and modifications are encompassed within the scope of the invention.

The invention has been described in detail above with reference to the specific exemplary embodiments. Features of the invention will be briefly recapitulated below.

A recording apparatus 1 according to a first embodiment of the invention includes a recording portion 7 capable of executing recording on a medium, a support portion 4 that supports the medium and that is movable in a movement direction A, and a movement operation portion O that accepts a movement operation for moving the support portion 4 to a desired position in the movement direction A.

According to this exemplary embodiment, the recording apparatus 1 includes the movement operation portion O that accepts the movement operation for moving the support portion 4 to a desired position in the movement directions A. Therefore, by operating the movement operation portion O, a user can easily move the support portion 4 to any desired position.

In the recording apparatus 1 according to a second exemplary embodiment of the invention based on the first exemplary embodiment, the movement operation portion O accepts the movement operation when the recording portion 7 is not executing recording.

According to this exemplary embodiment, the movement operation portion O accepts the movement operation when the recording portion 7 is not executing recording. Therefore, the support portion 4 can be moved to any desired position without interfering with the recording operation.

In the recording apparatus 1 according to a third exemplary embodiment of the invention based on the first or second exemplary embodiment, the movement operation portion O avoids accepting the movement operation when the recording portion 7 is executing the recording.

According to this exemplary embodiment, the movement operation portion O does not accept the movement operation when the recording portion 7 is executing recording. Therefore, it is possible to substantially prevent an incident in which during recording, a movement operation is accepted so that the recording operation is interfered with.

The recording apparatus 1 according to a fourth exemplary embodiment of the invention based on any one of the first to third exemplary embodiments is capable of changing moving speed of the support portion 4 according to duration of the movement operation accepted by the movement operation portion O.

Note that the "duration of the movement operation" means the time during which an operation of moving the support portion 4 (a move instruction) continues being carried out due to the movement operation portion O.

In this exemplary embodiment, the moving speed of the support portion 4 can be changed according to the duration of the movement operation accepted by the movement operation portion O. For example, in the case where the move instruction regarding the movement operation is continued, for example, in the case where the move button O1 or O2 as a movement operation portion O is pressed and held, the moving speed of the support portion 4 can be increased to efficiently move the support portion 4.

In the recording apparatus 1 according to a fifth exemplary embodiment of the invention based on any one of the first to fourth exemplary embodiments, the movement operation portion O may be formed in such a surface as to be visible in a plan view of the recording apparatus 1.

In this exemplary embodiment, the movement operation portion O is formed in such a surface as to be visible in a plan view of the recording apparatus 1. Therefore, the movement operation can be easily executed. If, for example, the movement operation portion O is constructed of buttons (the move buttons O1 and O2) formed in an arrangement along the movement directions A of the support portion 4, a lever O3 operable (movable) along the movement directions A of the support portion 4, etc., in a surface that is visible to users, the users can intuitively grasp the operations of the movement operation portion O.

The recording apparatus 1 according to a sixth exemplary embodiment of the invention based on any one of the first to fifth exemplary embodiments further includes an operation panel 19 that accepts various operations regarding recording, and the movement operation portion O is disposed in the vicinity of the operation panel 19.

Note that the "vicinity of the operation panel 19" means a range within the reach of a user who is at a position where the user can operate the operation panel 19 and this expression is meant to cover a construction in which the movement operation portion O is formed in the operation panel 19.

According to the exemplary embodiment, the recording apparatus 1 includes the operation panel 19 that accepts various operations regarding recording, and the movement operation portion O is disposed in the vicinity of the operation panel 19. Therefore, the user can easily operate the movement operation portion O at a position where the user operates the operation panel 19.

In the recording apparatus 1 according to a seventh exemplary embodiment of the invention based on any one of the first to sixth exemplary embodiments, the movement operation portion O is disposed in a vicinity of a setting position at which the medium is set onto the support portion 4.

Note that the "vicinity of the setting position" means a range within the reach of a user at a position where the user can set a medium onto the support portion 4.

According to this exemplary embodiment, the movement operation portion O is disposed in the vicinity of the setting position where the medium is set onto the support portion 4. Therefore, the user can easily operate the movement operation portion O at a position where the user performs the operation of setting the medium.

In the recording apparatus 1 of the invention according to an eighth exemplary embodiment based on any one of the first to fourth exemplary embodiments, the movement operation portion O is capable of accepting the movement operation in a state in which the movement operation portion O is remote from the recording apparatus 1.

Note that being "capable of accepting the movement operation in a state in which the movement operation portion O is remote from the recording apparatus 1" is meant to include a construction in which the movement operation portion O can accept the movement operation wirelessly and also a construction in which the movement operation portion O can accept the movement operation via a cable as long as the movement operation can be accepted in a state in which the movement operation portion O is remote from the recording apparatus 1.

According to this exemplary embodiment, the movement operation portion O is capable of accepting the movement operation in a state of being remote from the recording apparatus 1. Therefore, the user can easily operate the movement operation portion O even when at a position remote from the recording apparatus 1.

A moving method according to a ninth exemplary embodiment of the invention is a support portion moving method for a recording apparatus 1 that includes a recording portion 7 capable of executing recording on a medium and a support portion 4 that supports the medium and that is movable in a movement direction A. The support portion moving method includes moving the support portion 4 to a desired position in the movement direction A by using a movement operation portion O.

According to this exemplary embodiment, the support portion 4 is moved to a desired position in the movement direction A by using the movement operation portion O. Therefore, the support portion 4 can be easily moved to any desired position in the movement direction A by operating the movement operation portion O.

The entire disclosure of Japanese Patent Application No. 2015-013030, filed Jan. 27, 2015 is expressly incorporated reference herein.

What is claimed is:

1. A printer apparatus comprising:

an ink jet head capable of executing recording on a medium;

a support portion that supports the medium and that is movable in a movement direction; and a movement operation portion that receives user input, the user input depressing or moving the movement operation portion to thereby activate a movement operation of the recording apparatus for moving the support portion to a desired position in the movement direction, wherein the movement operation is performed while the user depresses or moves the movement operation portion.

2. The printer apparatus according to claim 1 wherein the movement operation portion accepts the movement operation when the ink jet head is not executing the recording.

3. The printer apparatus according to claim 1 wherein the movement operation portion avoids accepting the movement operation when the ink jet head is executing the recording.

4. The printer apparatus according to claim 1 which is capable of changing moving speed of the support portion according to duration of the movement operation accepted by the movement operation portion.

5. The printer apparatus according to claim 1 wherein the movement operation portion is formed in such a surface as to be visible in a plan view of the printer apparatus.

6. The printer apparatus according to claim 1 further comprising an operation panel that accepts various operations regarding the recording, wherein the movement operation portion is disposed in a vicinity of the operation panel.

7. The printer apparatus according to claim 1 wherein the movement operation portion is disposed in a vicinity of a setting position at which the medium is set onto the support portion.

8. The printer apparatus according to claim 1 wherein the movement operation portion is capable of accepting the movement operation in a state in which the movement operation portion is remote from the printer apparatus.

9. A support portion moving method for a printer apparatus that includes an ink jet head capable of executing recording on a medium and a support portion that supports the medium and that is movable in a movement direction, the support portion moving method comprising moving the support portion to a desired position in the movement direction by using a movement operation portion that receives user input, the user input depressing or moving the movement operation portion to thereby activate the movement operation of the printer apparatus for moving the support portion to a desired position in the movement direction, wherein the movement operation is performed while the user depresses or moves the movement operation portion.

* * * * *